US005451829A

United States Patent [19]

Snyder et al.

[11] Patent Number: 5,451,829

[45] Date of Patent: Sep. 19, 1995

[54] REFLECTOR MOUNT FOR AN INCANDESCENT LAMP HAVING A PLANAR FILAMENT ARRAY

[75] Inventors: Charles R. Snyder, Lexington; Kimberly P. Dunaway, Louisville, both of Ky.

[73] Assignee: North American Philips Corporation, New York, N.Y.

[21] Appl. No.: 124,319

[22] Filed: Mar. 18, 1991

Related U.S. Application Data

[63] Continuation of Ser. No. 446,499, Dec. 4, 1989, abandoned.

[51] Int. Cl.[6] ..... H01J 1/88

[52] U.S. Cl. ..... 313/273; 313/115

[58] Field of Search ..... 313/273, 113, 115

[56] References Cited

U.S. PATENT DOCUMENTS

| | | | |
|---|---|---|---|
| 3,082,345 | 3/1963 | Bottone | 313/113 |
| 3,441,772 | 4/1969 | Cardwell, Jr. | 313/113 |
| 3,445,713 | 5/1969 | Cardwell, Jr. | 313/273 |
| 3,555,338 | 1/1971 | Scoledge et al. | 313/113 |
| 3,590,305 | 6/1971 | Decaro | 313/115 |
| 3,777,207 | 12/1973 | Notelteirs et al. | 313/273 X |
| 4,145,630 | 3/1979 | Decaro et al. | 313/273 |
| 4,658,180 | 4/1987 | Ooms | 313/273 |
| 4,766,339 | 8/1988 | Berry et al. | 313/273 X |
| 4,897,573 | 1/1990 | Ooms | 313/273 |

*Primary Examiner*—Donald J. Yusko
*Assistant Examiner*—Brian Zimmerman
*Attorney, Agent, or Firm*—Brian J. Wieghaus

[57] ABSTRACT

A single-ended halogen incandescent projector lamp having a reflector mount fixed to the lamp frame remote from a bi-planar filament array. The lamp has a lamp envelope with a pinch seal at one end and a fused tip portion at the other. The lamp frame has a pair of frame conductors extending longitudinally in the lamp vessel, a pair of transverse quartz bridges between which the filament array is supported, and a frame center support extending into the fused tip portion from the bridge closest to the fused tip portion. The reflector mount is a single length of wire having a center portion coiled about and slidable along the frame center support, and a pair of legs extending therefrom to which the reflector is secured. The coiled portion is welded to the top center support to hold the reflector in position. Damage to the filament during lamp assembly is avoided since the reflector mount is fixed to the top center support instead of the frame conductors.

13 Claims, 1 Drawing Sheet

REFLECTOR MOUNT FOR AN INCANDESCENT LAMP HAVING A PLANAR FILAMENT ARRAY

This is a continuation of application Ser. No. 07/446,449, filed Dec. 4, 1989, abandoned.

BACKGROUND Of THE INVENTION

1. Field of the Invention

The invention relates to incandescent lamps having a planar filament array and a reflector adjacent the filament. More particularly, the invention concerns single-ended incandescent lamps having a planar filament array of adjacent coiled sections supported between two insulative bridges transverse to the lamp axis, and having a structure for supporting a reflector parallel to and spaced from the filament array.

2. Description of the Prior Art

Single-ended incandescent lamps having a planar filament array, such as tungsten halogen projector lamps, have a lamp envelope with a pinch seal at one end and a fused tip portion at the opposite end formed from tipping off an exhaust tube. The frame supporting the filament array generally has a pair of spaced rigid frame conductors extending from the pinch seal in the axial direction of the envelope and a pair of spaced insulative bridges extending transversely between the frame conductors. Filament retainers extend from the insulative bridges to support the individual coiled sections of the filament array. The filament retainers may, for example, have hook-shaped ends which engage looped portions joining the filament sections at each axial end of the filament array.

In one type of single-ended projector lamp, the insulative bridges are formed directly on the two frame conductors, which pass through and are embedded in each bridge near the opposite ends of the bridges. In a second type of lamp, the rigid conductors extend only through the bridge nearest the pinch seal. The second insulative bridge has, in addition to the filament retainers, a pair of wire supports fixed therein which extend towards the first bridge and have ends which are adapted for sliding on the rigid frame conductors. This construction permits tensioning of the filament array because the second bridge may be pulled away from the first bridge after the filament sections have been hooked on their respective retainers. After correctly tensioning the filament, the ends of the wire supports of the second bridge are welded to the frame conductors.

U.S. Pat. No. 3,555,338 discloses a quartz halogen lamp of the first type described above. The reflector is held parallel to the filament array by a pair of rods which are welded to one of the rigid frame conductors, extend therefrom transverse to the filament array, and are welded to an edge of the reflector. However, the welds securing the rods to the rigid conductor are difficult to make because of the close proximity of the weld points to the outer filament sections of the filament array. Additionally, specially shaped welding electrodes, in which one electrode has a right angle tip, are required to weld the transverse rods to the frame conductors.

In lamps of the second type described above, the filament is connected to the respective frame conductors by slipping-a short coiled section at each end of the filament array over the ends of the conductors and sliding them towards the first bridge. The looped portions joining adjacent coiled sections of the filament array are hooked on the filament retainers of the first bridge. The coiled end sections of the wire supports for the second bridge are then slipped over the rigid frame conductors and the filament retainers of the second bridge are hooked to respective looped portions of the filament array. The close proximity of the coiled end sections of the supports of the second bridge and the short coiled sections of the filament array on the frame conductors causes the additional problem that there is not sufficient space to weld the reflector support rods to the frame conductors while permitting proper positioning of the reflector.

U.S. Pat. 3,445,713 discloses a halogen incandescent lamp having a single quartz bridge and a reflector support wire embedded in the quartz bridge and welded to the top of the reflector. The single quartz bridge has filament retainers for holding the ends of the filament sections furthest from the pinch seal while the ends of the filament sections closest to the pinch seal are secured by filament retainers embedded directly in the pinch seal. However, embedding the reflector support wire in a quartz bridge is not suitable for frames of the second type, in which the bridge furthest from the pinch seal is slidable with respect to the other bridge to tension the filament array, because the variable position of the second bridge would vary the position of the reflector with respect to the filament array. Additionally, in smaller sized lamps, embedding the reflector support wire(s) in the quartz bridges is not practicable because they interfere with the placement of the filament retainers which are also anchored in the quartz bridge.

SUMMARY OF THE INVENTION

It is an object of the invention to provide a reflector mount in a single-ended incandescent lamp having a planar filament array which mount can be welded to the lamp frame at a location safely spaced from the filament array to avoid damage to the filament array during lamp assembly.

Another object of the invention is to provide a reflector mount which permits the reflector to be correctly positioned opposite the filament array in lamps having a quartz bridge which is movable during lamp assembly for filament tensioning.

Yet another object of the invention is to provide a reflector mount which can be manufactured from a single length of wire.

A further object of the invention is to provide a reflector mount to which the reflector can be secured before the mount is fixed to the lamp frame.

It is still a further object of the invention to provide a reflector mount which can be secured to the lamp frame in a simple manner and with only a single weld.

In the lamp according to the invention, the reflector support structure comprises a frame center support which extends axially from the center of the second bridge towards the fused tip portion of the lamp envelope and a reflector mount which is secured to the frame center support between the second quartz bridge and the fused tip portion of the envelope. The reflector mount comprises a single length of wire having a mounting portion formed to mount on the center support and at least one leg which is cantilevered from said mounting portion and extends from the mounting portion past the second quartz bridge and terminates at a free end. The reflector may be secured to the leg, for example, by welding.

The mounting portion of the wire may have any configuration which permits easy assembly on the center support. For example, the mounting portion may be formed for snapping on the top center support with a clamping fit or may be coiled for sliding over the top center support. During lamp assembly, the mounting portion is assembled on the center support and may be secured thereto by welding. The reflector may be fixed to the wire legs before or after the mounting portion is secured on the center support.

In the preferred embodiment of the invention, the reflector mount has a pair of elongate wire legs which extend from the mounting portion, which is coiled for sliding over the top center support. When assembled on the center support, the legs extend transverse to the lamp axis, at a predetermined angle with respect to each other, to a point where they are spaced a distance corresponding to the outer side edges of the reflector, at which point the legs bend through 90° and extend axially past the second bridge and the filament array in a plane parallel to and spaced from the filament array. The wire legs terminate at free ends.

Additionally, it is preferred that the center support extends from the second quartz bridge and has an end disposed within the tipped-off portion of the lamp envelope to provide additional support and alignment of the frame with the lamp axis.

BRIEF DESCRIPTION OF THE DRAWINGS

FIG. 1(*b*) shows a front view of the lamp of FIG. 1(*a*). In FIG. 1(*b*), the reflector and mount are not shown to better illustrate the frame structure for the filament array.

DESCRIPTION OF THE PREFERRED EMBODIMENT

Figure 1A:
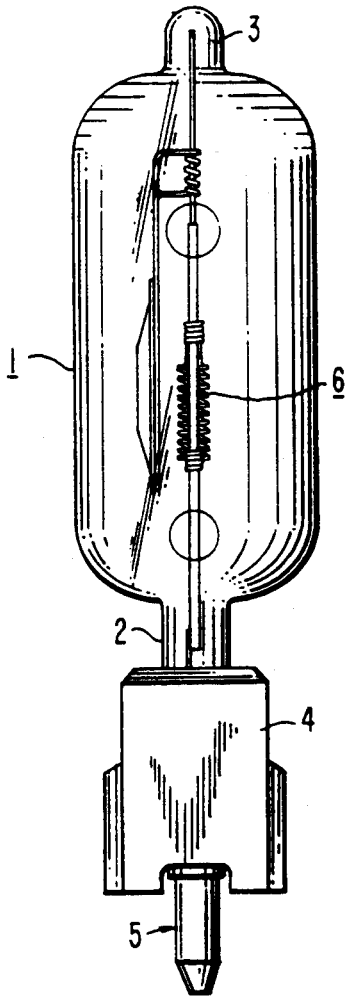
FIG. 1(*a*) shows a side view of a tungsten halogen incandescent lamp having a bi-planar filament array and reflector mounted parallel thereto.
Figure 1B:
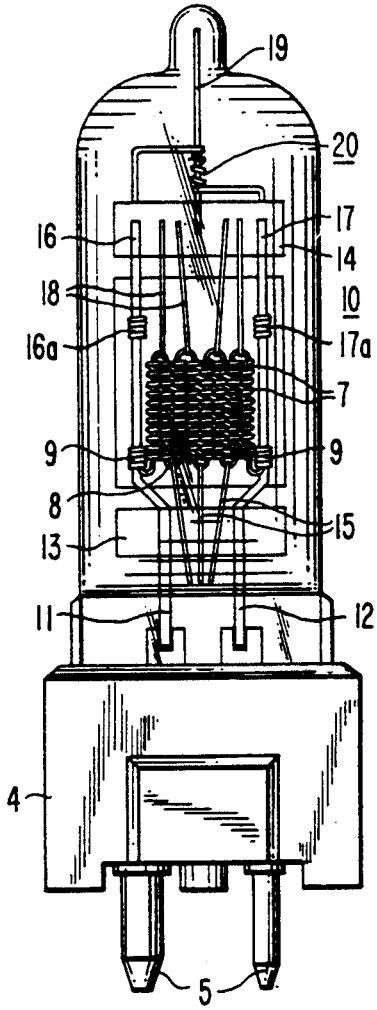

FIG. 1(*a*) shows a tungsten halogen incandescent lamp having a lamp envelope 1 with a pinch seal 2 at one end and a fused tip portion 3 at the opposite end formed from tipping off an exhaust tube. A lamp base 4 has a cavity therein for receiving the pinch seal 2 and a pair of base contacts 5. One of the contacts 5 is larger than the other so that the lamp may only be inserted into its socket with the reflector facing in the correct direction. The lamp has a bi-planar filament 6 having an array of straight coiled sections 7 disposed in side-by-side arrangement and joined by loop portions 8. (FIG. 1(*b*))

The frame 10 for supporting the filament has a pair of rigid frame conductors 11, 12 each having an end anchored in the pinch seal 2 and extending longitudinally in the lamp envelope. A first quartz bridge 13 extends transverse to the conductors 11, 12, which extend through and are embedded in the first bridge 13. A first set of filament retainers 15 are anchored in the bridge 13 and have hooked ends which engage looped portions 8 of the filament which join adjacent filament sections 7. A second bridge 14 has a second set of filament retainers 18 which hold the looped portions 8 at the end of the filament sections furthest from the pinch seal. A pair of bridge supports 16, 17, each having an end embedded in the second quartz bridge, extend axially therefrom towards the pinch seal and terminate at coiled end sections 16*a*, 17*a* which are sized for sliding over the frame conductor 11, 12. The end sections 16*a*, 17*a* of the bridge support and also the end sections 9 of the filament are welded to the conductors 11, 12. The frame center support 19 is a rigid length of wire having one end embedded in the quartz bridge 14 and the opposite end freely disposed in the protruding cavity defined by the fused tip portion 3.

Figure 2:
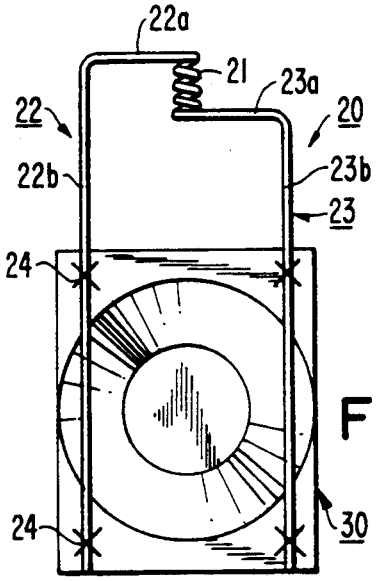
FIG. 2 shows the reflector welded to the reflector mount according to the preferred embodiment of the invention.
Figure 3:
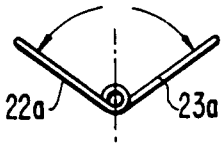
FIG. 3 shows a top view of the wire reflector mount support shown in FIG. 2.

As shown in FIGS. 2 and 3, the reflector mount 20 according to the invention comprises a length of wire having a center coiled portion 21, which is sized for closely fitting over the center support 19 and two elongate legs 22, 23 which are cantilevered extend from the coiled portion. The legs have portions 22*a*, 23*a* which extend from the coiled portion 21 transverse to the lamp axis and then curve through a 90° angle to sections 22*b*, 23*b* which extend parallel to the plane of the filament 6 in the assembled lamp. The portions 22*a*, 23*a* extend from the coiled portion for a distance and at an angle chosen such that the straight portions 22*b*, 23*b* are spaced sufficiently from each other so that they can be welded at points 24 near the side edges of the reflector and so that the reflector is supported by the cantilevered legs at the desired distance from the filament array. The legs terminate at free ends adjacent the lower edge of the reflector.

The lamp is assembled by providing a first frame sub-assembly comprising the rigid conductors 11, 12, quartz bridge 13, and filament retainers 15 disposed in the bridge. The coiled end sections 9 of the filament 6 are slid over the ends of the conductors 11, 12 towards the first bridge 13, and the loops 8 are placed over the hooked ends of the filament retainers 15. The second frame sub-assembly comprising the bridge 14, filament retainers 18 and bridge supports 16, 17 is then assembled on the first frame sub-assembly by sliding coiled end section 16*a*, 17*a* over the ends of the frame conductors 11, 12. The looped portions 8 on the side of the filament furthest from the pinch seal are hooked over tile ends of the second filament retainers 18. The quartz bridge 14 is then pulled in the direction away from the quartz bridge 13 to tension the filament sections, after which tile coiled ends 16*a*, 17*a* and the end sections 9 of the filament are welded to the conductors 11, 12.

The reflector mount 20, to which the reflector 30 has already been welded, is then assembled by sliding the coiled portion 21 over the center support 19. After axially positioning and rotationally aligning the reflector with respect to the filament 6, the coiled section 21 is welded to the center support 19 by one weld.

To complete the lamp, a quartz glass tube having a closed end with an exhaust tube and an open end is provided. The completed frame assembly including the filament array and the mounted reflector is then inserted into the tube through the open tube end with the end of the center support 19 disposed within the exhaust tube. A pinch seal is formed in a known manner at the open end to seal the conductors 11, 12, and the lamp envelope is then evacuated and provided with a gas fill through the exhaust tube by a known method. The exhaust tube is then tipped off with the center support freely disposed within the cavity formed thereby.

Since the location of the weld for fixing the coiled section of the reflector mount to the center support is far removed from the filament array, damage to the filament is avoided during lamp assembly. The reflector mount according to the preferred embodiment has the additional advantage that it requires only rotational alignment after it has been placed on the center support 19 since the legs are aligned parallel to the center coiled portion, which fits closely over the frame center support. The claimed reflector mount is also easier to handle than the two separate rods according to U.S. Pat. No. 3,555,338 since it is formed from a single length of wire.

Those of ordinary skill in the art will appreciate that various modifications can be made in the shape and arrangement of the frame and reflector mount without departing from the scope of the invention. For example, the two legs of the reflector mount may extend from the center coiled section in a plane other than transverse to the filament lamp axis. Additionally, other coil configurations or even non-coiled shapes are possible for the center section which would suitably slide over or snap on the top center support.

What is claimed is:

1. An electric incandescent lamp, comprising:

a lamp envelope defining a lamp axis and having a pinch seal;

a filament array arranged in said lamp envelope, said array comprising a plurality of coiled filament sections;

a frame for supporting said filament array comprising a pair of spaced frame conductors axially extending from said pinch seal, first and second axially spaced insulative bridges extending transversely in said lamp envelope, said bridges being supported by said rigid conductors with said second bridge spaced further from said pinch seal than said first bridge, and securing means for securing said filament sections between said insulative bridges;

means for energizing said filament array;

a reflector; and support means for supporting said reflector in said lamp envelope at a predetermined transverse distance from said filament array, characterized in that:

a center support extending from said second insulative bridge in the axial direction away from said pinch seal, and a reflector mount mounted on said center support comprise said support means, said reflector mount being a single length of wire. comprising a mounting portion formed for engaging said center support and an elongate leg extending from said mounting portion, said mounting portion being fixed on said center support and said leg being cantilevered from said mounting portion and extending past said second quartz bridge, said leg terminating at a free end and said reflector being fixed to said leg, and said wire mounting portion and said wire leg having sufficient strength and rigidity to support said reflector at said predetermined transverse distance from said filament array.

2. An incandescent lamp as claimed in claim 1, wherein said reflector mount has two said legs extending from said mounting portion, said legs extending parallel to and spaced from said filament array, said reflector being secured to both of said legs.

3. An incandescent lamp as claimed in claim 2, wherein said mounting portion comprises a portion of said length of wire coiled about said center support, said portion being sized for sliding closely over said center support, and means for fixing said portion with respect to said center support.

4. An incandescent lamp as claimed in claim 3, wherein said lamp envelope further comprises a fused tip portion opposite said pinch seal forming a protruding cavity in said envelope tip portion, and said center support extends from said second insulative bridge and has an end disposed in said cavity.

5. An incandescent lamp as claimed in claim 3, wherein said securing means comprises a plurality of wire filament retainers extending from said insulative bridges, each said retainer having an end holding a corresponding filament section.

6. An incandescent lamp, comprising:

a lamp envelope defining a lamp axis, said envelope having a pinch seal and a fused tip portion, said fused tip portion being at the end of the envelope opposite said pinch seal;

a lamp base holding said pinch seal and having a pair of base contacts;

a frame comprising a pair of axially extending and transversely spaced rigid frame conductors each having an end supported in said pinch seal, first and second axially spaced insulative bridges extending transversely in said lamp envelope, bridge securing means for securing said bridges to said frame conductors with said second bridge spaced further from said pinch seal than said first bridge, and a center support extending axially from said second bridge towards said fused tip portion and having an end disposed in said fused tip portion;

a planar filament array comprising a plurality of coiled filament sections axially extending between said bridges in side-by-side arrangement, said frame having filament retainers extending from said bridges holding said filament sections, and each end of said filament array being connected to a respective frame conductor;

means for electrically connecting said frame conductors to a respective base contact;

a reflector spaced a predetermined transverse distance from and facing said filament array and extending substantially parallel thereto; and a reflector mount comprising a single length of wire having a coiled center portion for sliding over said center support and two elongate legs extending from said coiled portion, said reflector mount being mounted on said center support with said center coiled portion coiled about said center support and with said legs cantilevered from said center portion and extending adjacent said filament array in a plane substantially parallel to said planar filament array, said legs terminating at free ends and said reflector being secured to said legs and said wire coiled portion and said wire legs being of sufficient strength and rigidity to hold said reflector at said predetermined transverse distance from said filament array.

7. An incandescent lamp as claimed in claim 6, wherein said bridge securing means comprises said rigid conductors extending through and embedded in said first bridge near respective opposite ends of said first bridge, and a pair of spaced wire supports extending from said second bridge and fixed to a respective frame conductor.

8. An incandescent lamp as claimed in claim 7, wherein said legs extend from opposite ends of said center coiled portion transverse to the lamp axis, curve through ninety degrees, and extend parallel to each other axially past said filament array, said legs extending from said coiled portion at an angle and for a distance chosen such that said axially extending portions are spaced for engaging opposite edge regions of said reflector.

9. An incandescent lamp as claimed in claim 6, wherein said bridge securing means comprises said rigid conductors extending through and embedded in respective opposite end portions of each of said bridges.

10. An incandescent lamp as claimed in claim 9, wherein said legs of said reflector mount extend from opposite ends of said coiled portion transverse to the lamp axis, curve through ninety degrees, and extend parallel to each other axially past said filament array, said legs extending from said coiled portion at an angle and for a distance chosen such that said axially extending portions are spaced for engaging opposite edge regions of said reflector.

11. A tungsten halogen incandescent lamp, comprising:

a lamp envelope defining a lamp axis, said envelope having a pinch seal and a fused tip portion, said fused tip portion being at the end of the envelope opposite said pinch seal;

a lamp base having a cavity for holding said pinch seal and having a pair of base contacts;

a planar filament array comprising a plurality of straight coiled filament sections disposed in side-by-side arrangement, said straight sections being joined by loop portions at opposite ends of said straight section;

a frame having first and second frame assemblies for holding said filament array, said first frame assembly comprising a pair of rigid frame conductors each having an end supported in said pinch seal and electrically connected to a respective base contact, said rigid conductors extending axially away from said pinch seal and being spaced from each other in the transverse direction of said lamp envelope, a first insulative bridge extending transversely between said conductors and having opposite end portions fused to said conductors, and a first plurality of filament retainers fixed in said bridge between said frame conductors and having hooked ends for holding corresponding filament sections, said second frame assembly comprising a second transverse insulative bridge spaced further from said pinch seal than said first bridge, a pair of wire bridge supports fixed in said second bridge near opposite ends of said second bridge, each bridge support extending axially in said envelope and terminating at coiled ends for sliding over a respective frame conductor, a frame center support fixed in said second bridge and having an end disposed in said fused tip portion of said lamp envelope, and a second set of filament retainers fixed in said second bridge between said wire supports and having hooked ends for holding corresponding filament sections, said filament array, at each end thereof, having outer coiled sections slid over and welded to a respective rigid frame conductor, and said filament array being disposed between said bridges with said hooked ends of said filament retainers holding corresponding loop portions, said second bridge being movable on said frame conductors for tensioning said filament sections during lamp assembly, and said coiled ends of said bridge support being welded to said rigid frame conductors for securing said second bridge with respect to said first bridge;

a reflector spaced a predetermined transverse distance from and facing said filament array, and extending substantially parallel thereto; and a reflector mount comprising a single length of wire having a coiled center portion for mounting on said center support and two elongate legs extending from said coiled portion, said reflector being secured to said legs and said coiled portion being slidable on said center support for adjusting the axial position of said reflector after said tensioning of said filament array, said coiled portion being fixably mounted on said center support with said center coiled portion coiled about said center support and with said legs cantilevered from said coiled portion and extending adjacent said filament array in a plane substantially parallel to said planar filament array, said legs terminating at free ends and said wire coiled portion and said wire legs being of sufficient strength and rigidity to hold said reflector at said predetermined transverse distance from said filament array.

12. An incandescent lamp as claimed in claim 11, wherein said legs of said reflector mount extend from opposite ends of said coiled portion transverse to the lamp axis, curve through ninety degrees, and extend parallel to each other axially past said filament array, said legs extending from said coiled portion at an angle and for a distance such that said axially extending portions are spaced for engaging opposite edges of said reflector.

13. An incandescent lamp as claimed in claim 12, wherein said filament is bi-planar and said filament retainers are angled from the lamp axis for holding corresponding filament sections in adjacent parallel planes.

* * * * *